US007661360B2

(12) United States Patent
Christel et al.

(10) Patent No.: US 7,661,360 B2
(45) Date of Patent: Feb. 16, 2010

(54) DEVICE FOR RECEIVING A CYLINDER OF A PRINTING UNIT AND CORRESPONDING PRINTING UNIT

(75) Inventors: Ralf Christel, Schlüsselfeld (DE); Oliver Frank Hahn, Veitshöchheim (DE); Karl Erich Albert Schaschek, Thüngen (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 289 days.

(21) Appl. No.: 11/658,137

(22) PCT Filed: Mar. 8, 2005

(86) PCT No.: PCT/EP2005/051021

§ 371 (c)(1),
(2), (4) Date: Jan. 23, 2007

(87) PCT Pub. No.: WO2006/015889

PCT Pub. Date: Feb. 16, 2006

(65) Prior Publication Data

US 2008/0066637 A1 Mar. 20, 2008

(30) Foreign Application Priority Data

Aug. 5, 2004 (DE) ..... 10 2004 038 206

(51) Int. Cl.
*B41F 13/14* (2006.01)

(52) U.S. Cl. ..... 101/248; 101/480

(58) Field of Classification Search ..... 101/480
See application file for complete search history.

(56) References Cited

U.S. PATENT DOCUMENTS

| | | | | |
|---|---|---|---|---|
| 4,615,266 | A * | 10/1986 | DeRoche et al. | 101/163 |
| 4,796,452 | A | 1/1989 | Schiel | |
| 5,692,439 | A | 12/1997 | Wech | |
| 6,494,135 | B1 | 12/2002 | Gottling et al. | |
| 6,494,138 | B1 | 12/2002 | Gottling et al. | |
| 7,011,023 | B2 | 3/2006 | Dittenhofer et al. | |
| 2001/0035104 | A1 | 11/2001 | Gottling et al. | |
| 2003/0089254 | A1 * | 5/2003 | Reder et al. | 101/248 |
| 2004/0107849 | A1 | 6/2004 | Christel et al. | |
| 2004/0144268 | A1 | 7/2004 | Christel et al. | |
| 2005/0034615 | A1 | 2/2005 | Holm et al. | |
| 2005/0211117 | A1 | 9/2005 | Koopmann | |
| 2006/0278106 | A1 | 12/2006 | Christel et al. | |

FOREIGN PATENT DOCUMENTS

| | | | |
|---|---|---|---|
| DE | 674 128 | | 4/1939 |
| DE | 36 10 107 | A1 | 10/1987 |
| DE | 101 45 321 | A1 | 4/2003 |
| DE | 101 45 322 | A1 | 4/2003 |
| EP | 1 375 137 | A2 | 1/2004 |
| EP | 1 375 137 | A3 | 5/2005 |

(Continued)

*Primary Examiner*—Daniel J Colilla
(74) *Attorney, Agent, or Firm*—Jones, Tullar & Cooper, P.C.

(57) ABSTRACT

A cylinder of a printing unit is received in a bearing structure that includes a bearing block having a rotary bearing and which is movable along an adjustment path in linear bearings. The bearing structure is configured as a bearing unit that can be mounted as a whole. The bearing structure thus includes the rotary bearing, the bearing block and the linear bearings which enable the relative movement of the bearing block.

11 Claims, 4 Drawing Sheets

FOREIGN PATENT DOCUMENTS

| | | | |
|---|---|---|---|
| WO | WO 01/49491 | A2 | 7/2001 |
| WO | WO 01/49491 | A3 | 7/2001 |
| WO | WO 02/081218 | A2 | 10/2002 |
| WO | WO 03/099567 | A1 | 5/2003 |

* cited by examiner

DEVICE FOR RECEIVING A CYLINDER OF A PRINTING UNIT AND CORRESPONDING PRINTING UNIT

CROSS-REFERENCE TO RELATED APPLICATIONS

This patent application is the U.S. national phase, under 35 USC 371, of PCT/EP2005/051021, filed Mar. 8, 2005; published as WO 2006/015889 A1 on Feb. 16, 2006 and claiming priority to DE 10 2004 038 206.9, filed Aug. 5, 2004, the disclosures of which are expressly incorporated herein by reference.

FIELD OF THE INVENTION

The present invention is directed to a device for seating a cylinder of a printing unit, as well as a printing unit. The device has a bearing block, which can be moved along an actuating direction in linear bearings, and has a rotary bearing. The actuating direction coincides with a plane connecting the axes of rotation of the cylinders to be placed against each other.

BACKGROUND OF THE INVENTION

In offset printing groups, the surface pressure required for ink transfer is achieved by compressing an elastic medium, such as, for example, a rubber coating, a printing cloth, a sleeve, or the like. To this end, a defined distance of the printing cylinder surfaces is set in the course of assembly and defines a print position. For various reasons it is necessary to set the cylinders in a contact-free manner.

In web-fed rotary printing presses, the printing cylinders are maintained in the print-on position in a geometrically defined position by stops. Three-ring bearings with eccentric rings are used for changing the positions of the centers of the cylinders. A movement of the center of a cylinder in the plane takes place by turning the eccentric rings. This way of realizing the eccentric displacement of the cylinder, by the use of levers and pneumatic actuation, entails various disadvantages. For one, a limitation of the structural space is caused because of synchronous spindles, typically located on each side I/side II, for each cylinder. Secondly, a large adjustment outlay is required because of an over-defined system, such as stops on S1 and S2, coupled by the synchronous spindle, and coupling of the horizontal and vertical displacement device. Thirdly, a great outlay for assembly is typically required.

Individual linear bearings for two transfer cylinders, each seated in a carriage, are known from WO 02/081218 A2. An actuating gear for the carriage can be embodied as a cylinder, which can be charged with a pressure medium. An adjustable stop is provided in order to define an end position for the actuating movement, which end position occurs transversely with respect to the cylinder plane. Actuation is performed by the use of a lever mechanism that is acting on the bearing block, which lever mechanism is actuated, for example, by a hydraulic cylinder and is synchronized on both sides by a synchronizing spindle.

U.S. Pat. No. 6,494,138 B1 discloses a device for seating cylinders, having a bearing block which is movable along an actuating path in linear bearings. The actuating direction S essentially coincides with a connecting plane of the axes of rotation of the cylinders which are to be placed against each other. The linear bearing has bearing elements which are fixed on the frame and are movable.

USP 2001/035 104 A1 also shows a device for seating cylinders, having a bearing block which can be moved along an actuating path in linear bearings. Fixation stations have been assigned to the forme cylinder, which stations are seated, linearly movable, on guide elements which are screwed to lateral frames.

DE 101 45 322 A1 discloses a seating unit of a cylinder, having a bearing block which is linearly movable in respect to a connecting structure in linear bearings and has a rotary bearing. The bearing block can be moved by the use of a displacement device.

SUMMARY OF THE INVENTION

The object of the present invention is directed to providing a compact seating unit for a printing group cylinder, as well as a printing unit which is easy to adjust.

In accordance with the present invention, the object is attained by the provision of a bearing block that can be moved along an actuating direction in linear bearings. The bearing block has a rotary bearing. The actuating direction substantially coincides with a plane connecting the axes of rotation of the cylinders that are to be placed together. The bearing block is embodied as a bearing unit in the manner of a modular unit which can be moved in one piece. At least one gear is integrated into the bearing unit. A length of the modular unit is less than, or equal to the diameter of the cylinder.

The advantages to be achieved by the present invention lie, in particular, in that as compact as possible a linear bearing unit is constructed, and into which unit the drive adjustment mechanism has already been integrated. Additional structural space for other components is provided, or new printing group arrangements are made possible. This is because the present invention provides as compact as possible a structure and further provides for the omission of devices which had previously been required for synchronizing the right and left bearing points, or displacement unit, such as, for example, a synchronizing rod.

A further advantage of the device for receiving a cylinder of a printing unit in accordance with the present invention is that a reduction of the assembly time can be achieved by pre-equipping or preassembling of cylinders with bearings, in particular.

BRIEF DESCRIPTION OF THE DRAWINGS

A preferred embodiment of the present invention is represented in the drawings and will be described in greater detail in what follows.

Shown are in.

DESCRIPTION OF THE PREFERRED EMBODIMENT

Figure 1:
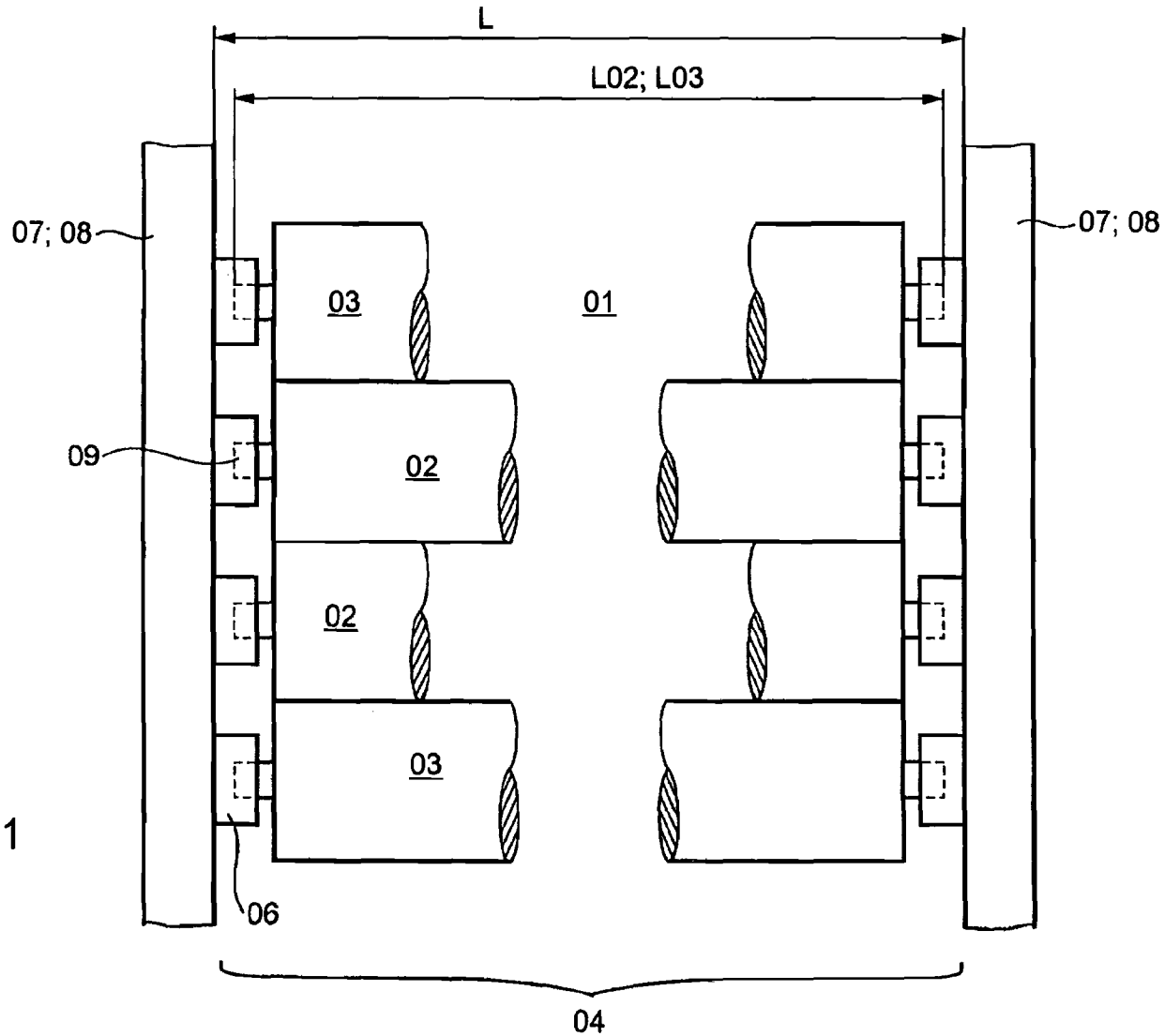
FIG. 1, a top plan view of a dual printing group in accordance with the present invention, in FIG. 2, a side elevation view through a bearing unit of the present invention and taken along the section II-II of FIG. 4, in FIG. 3, a schematic end view of a bearing unit, in FIG. 4, an end view of the lateral frame taken along the line IV-IV of FIG. 2, in FIG. 5, a side elevation view partly in cross-section and taken along the section V-V of FIG. 6 and depicting a bearing unit embodied as a worm drive, and in FIG. 6, a second side elevation view, partly in cross-section and taken along line VI-VI of FIG. 5 through the bearing unit depicted in FIG. 5.

Referring initially to FIG. 1, a printing press, such as, for example, a web-fed rotary printing press, and in particular a multi-color web-fed rotary printing press, has a printing unit in which a web of material, referred to as a web for short, can be imprinted on one or on both sides. The printing unit has a printing group 01 with at least one cylinder 02, 03, which can be engaged or disengaged. In FIG. 1 there is depicted a dual printing group 01 for use in imprinting both sides of a web in a rubber-against-rubber printing operation. The dual printing group 01, typically in the form of bridge printing groups or of n-printing groups, or also possibly configured as a level printing group with axes of rotation located in a common plane, is here constituted by two printing groups, each of which has a cylinder 02 embodied as transfer cylinder 02 and a cylinder 03 embodied as a forme cylinder 03, such as, for example, printing group cylinders 02, 03. The dual printing group 01 is typically provided, as well with an inking system, which is not specifically represented, and, in the case of wet offset printing, the dual printing group 01 is also provided with a dampening system. A dual print location is formed in the engaged position between the two respective transfer cylinders 02, all as may be seen in FIG. 1.

Modules which are embodied as cylinder units 04 preferably have, for example, cylinders 02, 03, each with journals 09 and each with a bearing unit 06 at each journal, which bearing unit 06 can be, or already has been, preassembled on the respective cylinder journal 09 and which bearing unit 06 for each journal is prestressed and/or preadjusted. The bearing unit 06 and the cylinders 02, 03 are put into their fixedly defined position with respect to each other prior to being inserted into the printing unit and can be placed together into the printing unit.

It is provided, in an advantageous embodiment of the present invention, to rotatably seat the cylinders 02, 03, in their bearing units 06, on lateral frames 07, 08, so that they do not extend through or beyond the alignment of the lateral frames 07, 08, and/or so that the cylinders 02, 03, inclusive of their cylinder barrels and further including their journals 09, have a cylinder length L02, L03, which, as may be seen in FIG. 1, is less than or equal to a clearance distance L between interior walls of the lateral frames 07, 08 supporting the printing group cylinders 02, 03 on both end faces. The lateral frames 07, 08 supporting the end assemblies of the printing group cylinders 02, 03 are preferably not lateral frames which are open on their sides in such a way that the cylinders 02, 03 could be axially removed. Instead, they are lateral frames 07, 08 which have at least a partial overlap with, or overlie, in the axial direction of the front of the assembled cylinder 02, 03, the front end of the cylinder 02, 03, and in particular its bearing, which bearing, as discussed below, is at least partially enclosed by the two lateral frames 07, 08.

Preferably all four printing group cylinders 02, 03 but at least three of the printing group cylinders each have their own bearing unit 06 at each cylinder end, and into which bearing unit 06, an engagement/disengagement mechanism, or at least one drive mechanism or gear 11 that is usable for providing relative movement between the bearing elements which are fixed in place and which are movable, has already been integrated. It is also possible to provide two of three of the cylinders, or to provide three of the four of the cylinders 02, 03 with bearing units 06 with the engagement/disengagement mechanism, and the third cylinder of the three cylinders, or the fourth cylinder of the four cylinders 02, 03 with bearing units without an engagement/disengagement mechanism.

Figure 2:
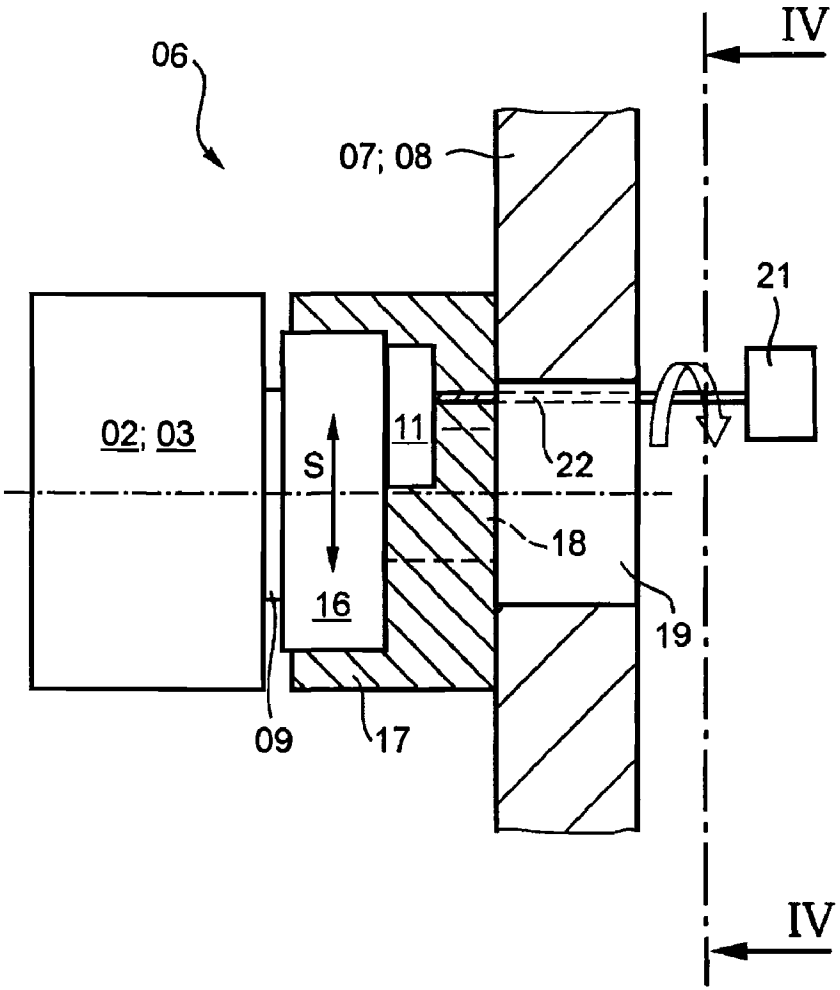
Figure 4:
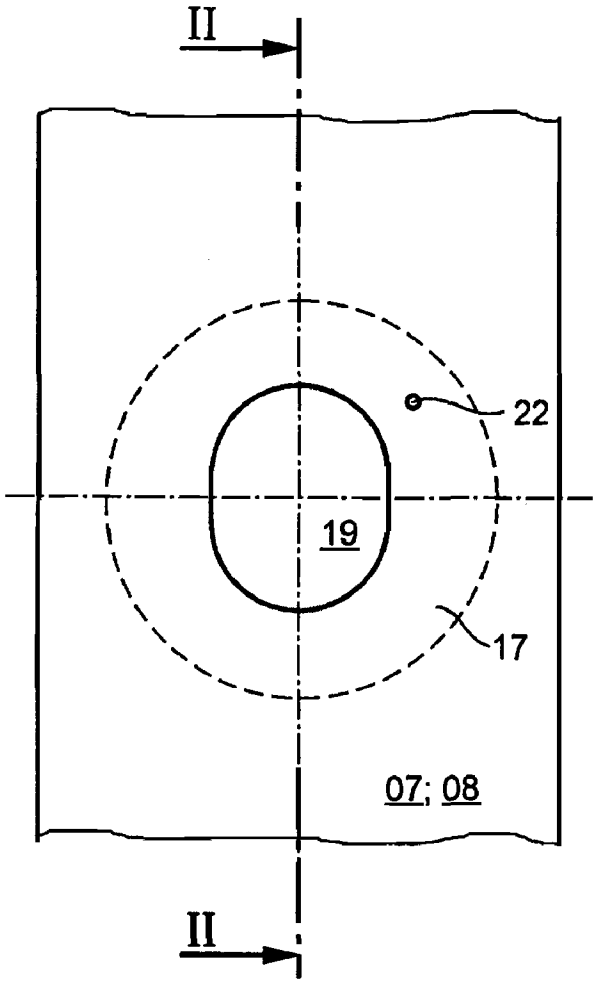
Figure 3:
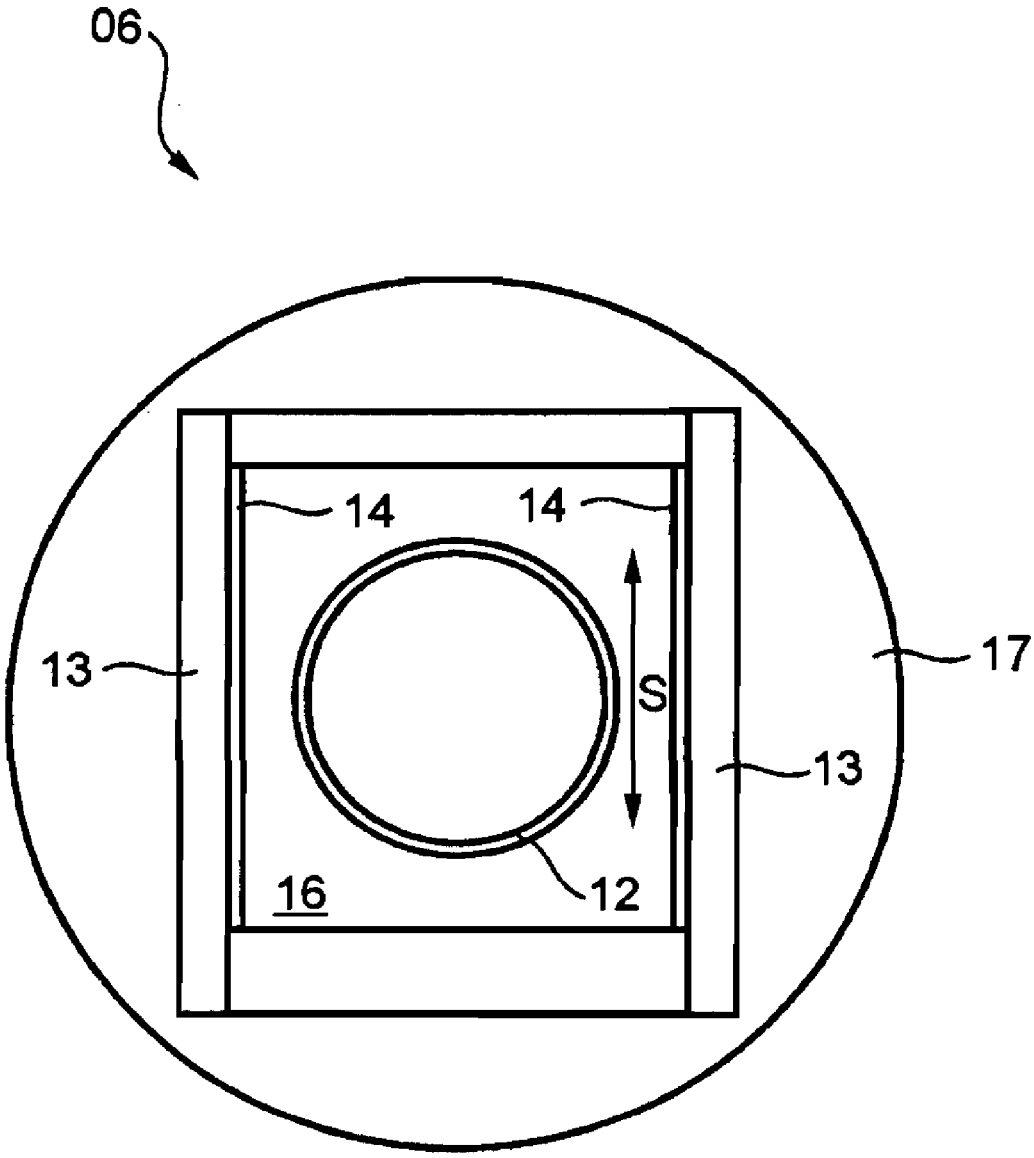

FIGS. 2 and 3 show a bearing unit 06 in accordance with the present invention in longitudinal and cross section, which is preferably based on linear actuating paths. In addition to the inclusion of a radial bearing 12, such as, for example, a cylinder rolling bearing 12, and which is usable for the rotatory seating of the cylinder 02, 03, the bearing unit 06, which further integrates the engagement/disengagement mechanism, or at least the drive mechanism or gear 11, has bearing elements 13, 14 for accomplishing a radial movement of the cylinder 02, 03, such as for print-on or print off. For this purpose, the bearing unit 06, which is fixed on the frame following the assembly of the cylinder unit 04 has bearing elements 13, which are fixed on supports, as well as bearing elements 14 which can be moved against the latter. The fixed and movable bearing elements 13, 14 are configured as cooperating linear elements 13, 14 and, through the provision of appropriate sliding surfaces or of interspersed rolling elements, are configured as linear bearings 13, 14 as a whole. Between themselves, the linear elements 13, 14 receive, for example in pairs, a bearing block 16, which bearing block 16 is structured for receiving the radial bearing 12, and which may be configured, for example, as a carriage 16. The bearing block 16 and the movable bearing elements 14 can also be embodied as one piece. The bearing elements 13, which are fixed on a support, are arranged on a support 17 which, as may be seen in FIGS. 2 and 3 may be configured with a circular base, which support 17 will be, or is, connected in one piece with the respective lateral frame 07, 08. The support 17 can be embodied as a base plate, or as an enclosure, with a circular, rectangular or other basic shape which, for example, has a recess 18, as is indicated in FIG. 2 in dashed lines, at least on a driving side, for the passage of a drive shaft, which is not specifically represented, of a cylinder journal 09. The frame wall 07, 08 which is on the driving side of the printing unit preferably has a recess and, in particular has a recess which is configured as an elongated hole, or as an opening 19 for the receipt or the passage of a non-represented drive shaft, which drive shaft is to be connected, fixed against relative rotation, with the journal 09. It is not necessary to provide either a recess 18 or an opening 19 on the front frame element face which is opposite the driving side of the printing unit.

The embodiment of the linear bearings 13, 14 in such a way that the cooperating bearing elements 13, 14 are both provided on the component bearing unit 06, and are not a part on the lateral frame 07, 08 of the printing unit, allows the preassembling and preadjustment, or setting, of the bearing tension. The advantageous arrangement of the two linear bearings 13, 14 enclosing the bearing block 16 makes possible their setting free of play. The two linear bearings 13, 14 are located opposite each other in such a way that the bearing prestress and the bearing forces have, or absorb, a substantial component in a direction which is perpendicular with respect to the axis of rotation of the cylinder 02, 03. Thus, the bearings can be adjusted in that direction which is important for the setting, free of play, of the cylinders 02, 03. The bearing elements 13, which are fixed in place on the frame, are arranged substantially parallel with respect to each other and define an adjusting direction S, as may be seen in FIG. 3.

Because each cylinder 02, 03, including its journal 09 and the bearing unit 06, do not penetrate the frame wall 07, 08, these cylinders can be placed into the printing unit, already preassembled and with the bearings, and specifically with radial bearing 12, as well as linear bearings 13, 14, preset, or correctly prestressed, as the modular bearing unit 06. The term "not penetrating", as well as being understood in the context of the above definition in regard to the clearance, is also advantageously intended to be understood in the wider sense that there is such "non-penetration" at least along a continuous path extending from a frame peripheral edge to a location of the final position of the bearing unit 06, so that the cylinder unit can be brought into its final position from an open side located between the two lateral frames 07, 08, such as, for example, at the front side without tilting, and can be brought in a position with an axis of rotation which is perpendicular with regard to the frame level, and can be arranged there between the two frame walls, and in particular can be fastened on the inner frame walls. This is, for example, also possible even if sprue elements or other elevations are provided on the inside of the frame walls, as long as such a continuous assembly path has been provided.

Assembling aids, such as, for example, locating pins, which are not specifically depicted, can be provided in the lateral frame 07, 08 for insuring correct placement of the cylinder unit, and on which assembling aids the bearing unit 06 of the preassembled cylinder unit 04 is aligned prior to being connected with the lateral frame 07, 08 by the use of releasable holding mechanisms, such as, for example screws, or even by a material connection such as, for example, by welding. To set the bearing prestress in the linear bearings 13, 14, which presetting should be performed prior to their placement into the printing unit and/or after they have been placed there, it is possible to provide appropriate mechanisms, which are not specifically represented, such as clamping screws, for example. The bearing unit 06 is protected to a large extent, at least in the direction of the cylinder, against dirt by a cover, which is also not specifically represented, or which is even embodied encapsulated as a modular unit.

The bearing units 06 for the forme cylinder 02 and for the transfer cylinders 03 are identically constructed, possibly except for the permitted operational length of the actuating path, as modular units. Because of the embodiment of the present invention, with preassembly of the components, the effective interior face of the radial bearing 12 and the effective exterior shell face of the journal 09 can be embodied cylindrically instead of conically. This is because the assembly of the bearing unit 06 on the journal 09, as well as the adjusting of the play of the bearing, can still be performed outside of the printing unit. A cylindrical shaft seating is preferably provided between the journal 09 and the radial bearing 12. The bearing unit 06, or the radial bearing 12, can be shrunk on the journal 09, for example, and the assembly of the preassembled cylinder unit 04, complete with the bearing, in the lateral frame 07, 08 can take place. In this case, the prestressing of the bearing is achieved by the fitting of the shaft seating ring and the inner rolling bearing ring and need not be adjusted during the assembly of the cylinder 02, 03 in the printing unit. This provides a significant time savings during assembly.

The bearing unit 06, and in particular the linear bearing unit 06, has the linearly movable carriage 16, or guide carriage as its movable part, which carriage or bearing block 16 receives the radial bearing 12, and possibly also has an axial bearing, for example for use in adjusting the lateral registration of the cylinder 03, and has a degree of freedom extending perpendicularly with respect to the cylinder shaft. The stationary part, and specifically the support 17 with bearing elements 13 of the bearing unit is fastened, such as, for example by being screwed, on the inside of the lateral frame 07, 08.

A gear 11, which, in particular, is provided free of play or which is prestressed, is integrated into this stationary part of the bearing unit 06. Gear 11 converts an actuating movement, that is introduced from the outside of the bearing unit 06 on a member of the drive gear 11, into a linear movement of the carriage or bearing block 16. Preferably, as depicted in FIG. 2, a gear 11 has been integrated in the support 17. This gear 11 is embodied to convert the rotary movement of an actuating mechanism 21, or actuating assembly 21, which is only schematically indicated, for example via a shaft 22, into a linear movement of the carriage or bearing block 16 perpendicularly with respect to the shaft 22 or the axis of the actuating gear, and/or perpendicularly with respect to the cylinder shaft. For example, this gear 11 can contain a rotating gear wheel which is driven by the shaft 22, and which cooperates with a toothed rack that is assigned to the movable part. However, it can also be configured in other ways. The actuating gear or mechanism 21 is preferably embodied in a manual format as a rotatory gear, or preferably in an automatic format as an electric motor, and in particular as an electric motor which is operable by remote control. This actuating gear or gear mechanism 21 is advantageously arranged connected to, for example by being flanged, to the back of the bearing unit 06, and in particular on the side of the lateral frame 07, 08 which is facing away from the bearing unit 06, and having a face which is adapted for screwing on the frame. The axis of rotation of the actuating gear or gear mechanism 21 preferably extends substantially parallel to, but offset, with respect to the cylinder axis.

Figure 5:
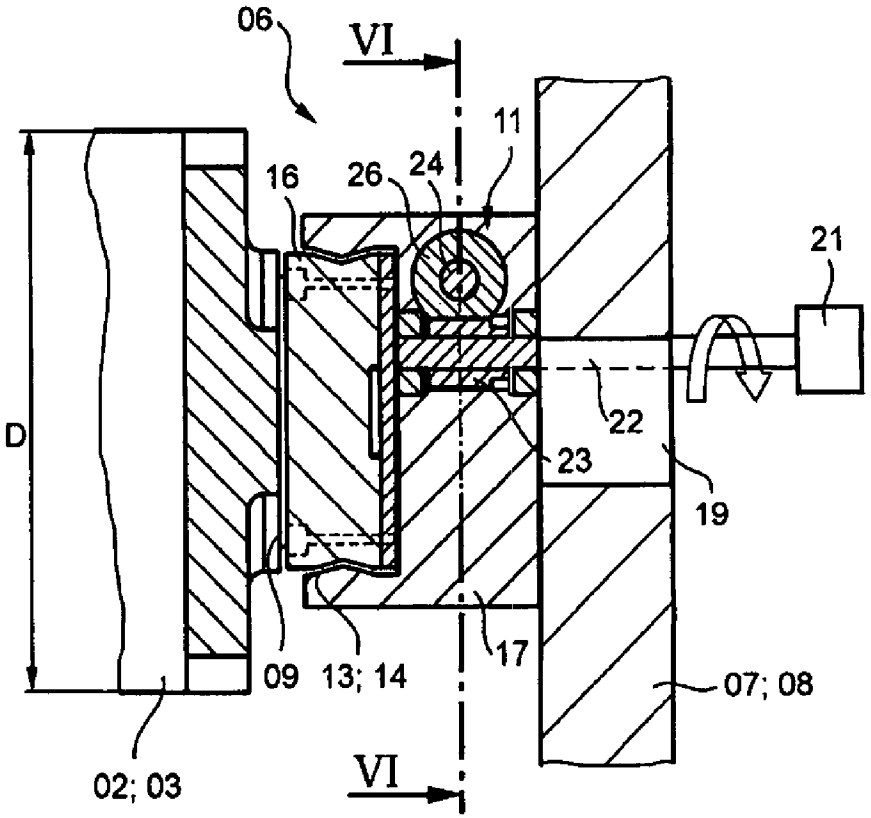
Figure 6:
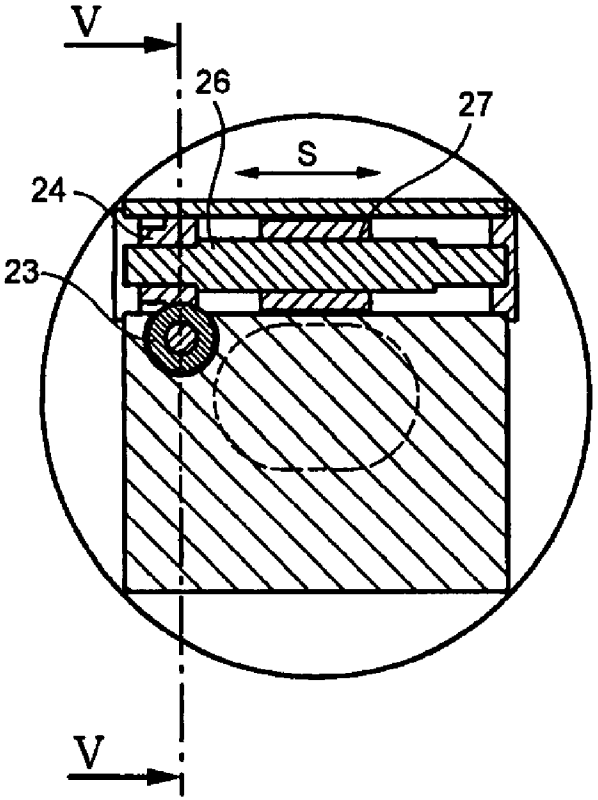

An advantageous embodiment of the drive mechanism or gear 11, as an alternative to the above mentioned toothed rack solution, is represented in FIGS. 5 and 6.

A rotatory actuating gear or adjusting mechanism 21, such as, for example, a step motor 21, is again provided. A step motor 21 is provided for each of the two bearing units 06 of the respective cylinder 02, 03, preferably in regard to accomplishing a synchronous movement of the cylinder 02, 03 between the two lateral frames 07, 08 at the front. In an advantageous embodiment, an adaptive gear, such as, for example, in the form of a planetary gear placed on top, and which is not specifically represented, is provided upstream of the actuating gear or mechanism 21. The drive mechanism 11 which converts the rotary movement of the actuating gear 21 into the linear movement of the bearing unit 06 has an angular gear assembly 23, 24 and in particular a self-locking one, such as, for example, a worm gear assembly consisting of a worm shaft 23, which is connected, fixed against relative rotation, with the shaft 22 of the actuating mechanism 21, and a cooperating worm wheel 24. The worm wheel 24 is connected, fixed against relative rotation, with a threaded spindle 26, which is seated stabilized, but rotatable, in the bearing unit 06 and which threaded spindle 26, in turn, works together with a spindle lifting element 27 having an interior thread. The spindle lifting element 27 is rigidly connected, either directly, or via a connector, with the bearing block or carriage 16, which is hidden in FIG. 6, in such a way that the bearing block or carriage 16 follows, preferably free of play, the movement of the spindle lift element 27 in regard to the actuating direction S. In this case, the embodiment of the worm gear assembly 23, 24 as a self-locking worm gear is advantageous, since because of this the axes of the shaft 22 and of the linear actuating path of the spindle lifting element 27 extend orthogonally, with respect to each other. The conversion gear assembly 26, 27, converting rotatory to linear motion, and constituted by the threaded spindle 26 and the spindle lifting element 27, can preferably be prestressed and/or can be embodied as a ball screw gear.

The angular gear assembly 23, 24, as well as the conversion gear assembly 26, 27, have been completely integrated into the bearing unit 06, as may be seen most clearly in FIG. 5.

In cross section, the structural space of the bearing unit 06 should preferably be less than, or at most equal to, the cross-sectional face of the cylinder 02, 03 or, if so provided, of a bearer ring diameter In a first variation, at least one of the two measures of the bearing unit 06, length and/or width, here called an edge measurement, should be less than, or at most equal to, the diameter D of the cylinder 02, 03 or, if provided, of a cylinder bearer ring. In one embodiment, in which the actuating direction S substantially coincides with a plane connecting the axes of rotation of the cylinders 02, 03, which are to be placed against each other, at least the bearing unit length should be less than, or equal to, the diameter D. In an embodiment in which the actuation direction substantially extends perpendicularly with respect to the plane connecting the axes of rotation, at least the bearing unit width should be less than, or equal to, the diameter D. In an even more advantageous variation of the present invention, the bearing unit 06 should have such dimensions, that, in its dimensions, the bearing unit 06 does not extend past the cross-sectional surface of the cylinder 02, 03. In other words the maximum diagonal dimension e, which is here identified as a corner measure, is less than, or at most equal to, the diameter D, so that $e \leqq D$.

The length and/or the width are preferably less than, or equal to, 300 mm. Preferably, the maximum diagonal dimension e is less than, or equal to, 300 mm. In a still more advantageous embodiment, because it is variable, the length and/or the width of the bearing unit 06 are less than, or equal to, 200 mm, or even less than, or equal to, 150 mm. The latter is particularly advantageous in connection with cylinders 02, 03 of a circumference which only corresponds to a single newspaper page, typically called a single circumference cylinder.

A force measurement is advantageously integrated in the frame of the bearing, or in the gear, so that, for example, the electrical current consumption of the motor or actuating mechanism 21, or a moment in the gear, for example, or the torsion moment of the spindle, or the like, is determined and is evaluated. In this way, it is possible, such as, for example, following an appropriate calibration, to reproducibly set the contact pressure of the cylinders 02, 03, which contact pressure is important for accomplishment of the ink transfer, and therefore the print result.

In a printing unit with at least three cylinders 02, 03, such as, for example, with a counter-pressure cylinder), which three cylinders work together as a printing group 01, at least two of the three cylinders 02, 03 are seated in such linear bearings 13, 14, respectively, and are movable along an actuating direction S which, together with a connecting plane which is formed with the inclusion of the axes of rotation of the cylinders to be adjusted and of the cylinder 02, 03 following in the connecting direction, maximally includes an angle of 15°. In this case, the movable cylinder 02, 03 is only seated in the above-described bearing units 06 which are assigned to this cylinder 02, 03.

As previously mentioned, the linearly movable cylinders 02, 03 are preferably preassembled, or can be preassembled, together with their respective front-side or end bearing units 06, into a cylinder unit 04. As a modular unit, with barrels and with two front-side or end journals 09, these cylinders 02, 03 have the above mentioned maximum length L02, L03.

In a printing group 01, which is embodied as a double printing group 01, at least the two forme cylinders 03 and at least one of the two transfer cylinders 02 are preferably seated so that they can be linearly moved in this way. The second transfer cylinder 02 can be operationally fixed in the frame, however being seated so that its position is adjustable. However, in a variation of the present invention, all four cylinders 02, 03 can be seated linearly movable in this way.

In a three-cylinder printing group 01 for use in accomplishing one-sided imprinting, at least two, and in particular, at least the two ink-conducting cylinders 02, 03, such as, for example, the forme cylinder and the transfer cylinder 02, 03, are seated linearly movable in this way, however, in a variation even all three cylinders can be supported to be linearly movable.

While preferred embodiments of a device for receiving a cylinder of a printing unit and a corresponding printing unit, in accordance with the present invention, have been set forth fully and completely hereinabove, it will be apparent to one of skill in the art that changes in, for example the specific structure of the bearing in the bearing block, the thread pitches of the worn shaft and worm gear, and the like could be made without departing from the true spirit and scope of the present invention which is to be limited only by the appended claims.

What is claimed is:

1. A device for supporting a cylinder of a printing unit including cooperating cylinders comprising:

a printing unit frame a bearing unit mountable as a modular unit on said printing unit frame and having a bearing unit length;

linear bearing elements in said modular bearing unit, and including a pair of spaced, fixed linear bearing elements securable to said printing unit frame and movable linear bearing elements which are movable in said fixed linear bearing elements and with respect to said printing unit frame;

a bearing block supported directly by said movable linear bearing elements and being supported between, and movable with respect to said pair of fixed spaced linear bearing elements in said bearing unit in an actuating direction, which actuating direction coincides with a plane defined by axes of rotation of said cooperating cylinders;

a rotary bearing positioned in said bearing block and between said pair of spaced fixed linear bearing elements, said rotary bearing being adapted to receive an end journal of said cylinder to be supported by said modular bearing unit;

a drive in said modular bearing unit and usable to provide relative linear movement between said bearing block, which is supported between said fixed linear bearing elements of said modular bearing unit which are fixed on said frame, and said movable linear guide elements of said modular bearing unit and which directly support said bearing block and which are movable with respect to said frame; and a diameter of said cylinder, said length of said modular bearing unit in said plane being not greater than said diameter of said cylinder.

2. The device of claim 1 wherein said modular bearing unit includes a bearing unit back adjacent said printing unit frame and wherein said drive gear is adjacent said bearing unit back.

3. The device of claim 1 wherein said drive gear is an angular drive gear.

4. The device of claim 1 further including an actuating mechanism arranged outside of said modular bearing unit, said drive gear converting an actuating movement exerted by said actuating mechanism into a linear movement of said bearing block.

5. The device of claim 4 wherein said drive gear converts a rotary movement of said actuating mechanism into said linear movement of said bearing block perpendicular to an axis of rotation of said cylinder.

6. The device of claim 4 wherein said actuating mechanism includes a rotary actuating gear.

7. The device of claim 6 wherein an axis of rotation of said rotary actuating gear extends parallel to, and offset from an axis of rotation of said cylinder.

8. The device of claim 4 wherein said actuating mechanism includes an electric motor.

9. The device of claim 4 wherein said actuating mechanism is located on a side of said frame facing away from said modular bearing unit.

10. The device of claim 1 wherein said drive gear includes a gear wheel and a cooperating toothed rack.

11. The device of claim 1 wherein said linear bearings include first and second ones of said fixed linear bearing elements located opposite each other and extending around said bearing block to cause a bearing prestress in a direction perpendicular to an axis of rotation of said cylinder.

* * * * *

UNITED STATES PATENT AND TRADEMARK OFFICE

CERTIFICATE OF CORRECTION

PATENT NO. : 7,661,360 B2
APPLICATION NO. : 11/658137
DATED : February 16, 2010
INVENTOR(S) : Ralf Christel et al.

It is certified that error appears in the above-identified patent and that said Letters Patent is hereby corrected as shown below:

Column 8, in claim 1, line 49, after "drive", insert --gear--.

Signed and Sealed this

First Day of June, 2010

David J. Kappos

David J. Kappos
*Director of the United States Patent and Trademark Office*